US012569101B2

(12) United States Patent
Seo et al.

(10) Patent No.: US 12,569,101 B2
(45) Date of Patent: Mar. 10, 2026

(54) ROBOT CLEANER, DOCKING STATION AND CLEANING SYSTEM HAVING THE SAME

(71) Applicant: SAMSUNG ELECTRONICS CO., LTD., Suwon-si (KR)

(72) Inventors: Junwon Seo, Suwon-si (KR); Hongseok Choi, Suwon-si (KR); Sunghyun Kim, Suwon-si (KR); Elijah Kim, Suwon-si (KR); Juyeong Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 335 days.

(21) Appl. No.: 18/205,025

(22) Filed: Jun. 2, 2023

(65) Prior Publication Data

US 2024/0041290 A1 Feb. 8, 2024

Related U.S. Application Data

(63) Continuation of application No. PCT/KR2023/006850, filed on May 19, 2023.

(30) Foreign Application Priority Data

Aug. 4, 2022 (KR) ..... 10-2022-0097473

(51) Int. Cl.
*A47L 11/40* (2006.01)

(52) U.S. Cl.
CPC ..... *A47L 11/4011* (2013.01); *A47L 11/4005* (2013.01); *A47L 11/4036* (2013.01); *A47L 11/4091* (2013.01); *A47L 2201/022* (2013.01)

(58) Field of Classification Search
CPC ..... A47L 11/4011; A47L 11/4005; A47L 11/4036; A47L 11/4091
See application file for complete search history.

(56) References Cited

U.S. PATENT DOCUMENTS 8,756,751 B2 * 6/2014 Jung ..... A47L 9/2815 15/319
9,027,199 B2 5/2015 Jung et al.
(Continued)

FOREIGN PATENT DOCUMENTS

CN 215959640 U 3/2022
CN 114305229 A 4/2022
(Continued)

OTHER PUBLICATIONS

International Search Report dated Aug. 2, 2023 in International Patent Application No. PCT/KR2023/006850.
(Continued)

*Primary Examiner* — Marc Carlson
(74) *Attorney, Agent, or Firm* — STAAS & HALSEY LLP

(57) ABSTRACT

A docking station for a cleaner including a docking unit including an upper surface forming a travel route along a first direction for a robot cleaner to move upon to enter the docking station; and a floorcloth separator including a protrusion, and configured so that the protrusion protrudes from a predetermined area of the upper surface of the docking unit such that a free end of the protrusion is defined along a second direction different from the first direction, and while a robot cleaner with a floorcloth attached thereto travels on the travel route along the first direction, at least a portion of the protrusion is inserted between the robot cleaner and the attached floorcloth to separate the attached floorcloth from the robot cleaner.

20 Claims, 14 Drawing Sheets

(56) References Cited

U.S. PATENT DOCUMENTS

| | | | | |
|---|---|---|---|---|
| 9,186,030 | B2 | 11/2015 | Jung et al. | |
| 9,717,388 | B2 * | 8/2017 | Jeong | A47L 11/4036 |
| 10,028,631 | B2 | 7/2018 | Jung et al. | |
| 10,730,397 | B2 * | 8/2020 | Romanov | B60L 15/20 |
| 11,690,493 | B2 * | 7/2023 | Weis | A47L 11/4036 15/98 |
| 12,329,337 | B2 * | 6/2025 | Xie | A47L 11/4091 |
| 2018/0296051 | A1 | 10/2018 | Jung et al. | |
| 2020/0077858 | A1 * | 3/2020 | Zhang | A47L 11/4019 |
| 2021/0228044 | A1 | 7/2021 | Zhang et al. | |
| 2021/0228045 | A1 | 7/2021 | Zhang et al. | |
| 2022/0142436 | A1 | 5/2022 | Zhang et al. | |
| 2022/0142437 | A1 | 5/2022 | Zhang et al. | |
| 2022/0211241 | A1 * | 7/2022 | Zheng | A47L 11/4011 |
| 2023/0271334 | A1 * | 8/2023 | Kim | B25J 9/0003 |
| 2024/0041293 | A1 * | 2/2024 | Kim | A47L 11/4011 |

FOREIGN PATENT DOCUMENTS

| | | | | | |
|---|---|---|---|---|---|
| CN | 114343497 | A | | 4/2022 | |
| CN | 114711688 | A | | 7/2022 | |
| CN | 119584908 | A | * | 3/2025 | A47L 11/4005 |
| JP | 2020-099666 | A | | 7/2020 | |
| KR | 10-2012-0007943 | A | | 1/2012 | |
| KR | 10-2013-0113167 | A | | 10/2013 | |
| KR | 10-2103420 | | | 5/2020 | |
| KR | 10-2021-0086458 | A | | 7/2021 | |
| KR | 10-2021-0105907 | A | | 8/2021 | |
| KR | 10-2289499 | | | 8/2021 | |
| KR | 10-2022-0004159 | A | | 1/2022 | |
| KR | 10-2022-0020360 | A | | 2/2022 | |
| WO | WO 2020/125760 | A1 | | 6/2020 | |
| WO | 2021/104689 | A1 | | 6/2021 | |
| WO | WO-2022253345 | A1 | * | 12/2022 | A47L 11/28 |

OTHER PUBLICATIONS

Written Opinion of the International Searching Authority dated Aug. 2, 2023 in International Patent Application No. PCT/KR2023/006850.

* cited by examiner

ROBOT CLEANER, DOCKING STATION AND CLEANING SYSTEM HAVING THE SAME

CROSS-REFERENCE TO RELATED APPLICATIONS

This application is a continuation application of International Application No. PCT/KR2023/006850 designating the United States, filed on May 19, 2023, in the Korean Intellectual Property Receiving Office, which claims priority from Korean Patent Application No. 10-2022-0097473, filed on Aug. 4, 2022, in the Korean Intellectual Property Office, the disclosures all of which are hereby incorporated by reference herein in their entireties.

BACKGROUND

1. Field

Embodiments of the present disclosure relate to a robot cleaner capable of attaching a floorcloth docking, a docking station providing automatic replacement of the floorcloth attached to the robot cleaner, and a cleaning system including the same.

2. Description of Related Art

A robot cleaner is a device for automatically cleaning a certain cleaning space while travelling throughout the cleaning space without any user's manipulation. In general, a robot cleaner can perform the operation of sucking foreign substances such as, e.g., dust accumulated on a surface (e.g., a floor surface) to be cleaned or wiping foreign substances such as, e.g., dirt attached to the surface to be cleaned with a floorcloth. Amongst such robot cleaners, a type of robot cleaner is used in which the floorcloth (or damp cloth) is attached to its one end and the floorcloth is rotated to wipe out the foreign substances attached to the surface to be cleaned.

Typically, as the cleaning progresses, the floorcloth attached to the robot cleaner may get more and more contaminated, and therefore, its user has to replace the contaminated floorcloth attached to the robot cleaner with a new floorcloth, so as to continue an effective cleaning.

SUMMARY

Aspects of embodiments of the disclosure will be set forth in part in the description which follows and, in part, will be apparent from the description, or may be learned by practice of the presented embodiments.

Embodiments of the disclosure may provide a docking station for supporting replacement of a floorcloth attached to a robot cleaner to be used for cleaning, and a robot cleaner corresponding thereto.

According to an embodiment of the disclosure, docking station for a cleaner may include a docking unit including an upper surface forming a travel route along a first direction for a robot cleaner to move upon to enter the docking station; and a floorcloth separator including a protrusion, and configured so that the protrusion protrudes from a predetermined area of the upper surface of the docking unit such that a free end of the protrusion is defined along a second direction different from the first direction, and while a robot cleaner with a floorcloth attached thereto travels on the travel route along the first direction, at least a portion of the protrusion is inserted between the robot cleaner and the attached floorcloth to separate the attached floorcloth from the robot cleaner.

According to an embodiment of the disclosure, the upper surface of the docking unit includes a ramp inclined along the first direction, and the predetermined area from which the protrusion protrudes is disposed on the ramp.

According to an embodiment of the disclosure, the protrusion has a wedge shape protruding from the predetermined area of the upper surface at an acute angle with respect to the upper surface of the docking unit.

According to an embodiment of the disclosure, the docking unit includes an opening formed so that at least part of the opening is located below the protrusion, and the floorcloth separated from the robot cleaner is entered into the docking unit through the opening as the robot cleaner moves over the protrusion.

According to an embodiment of the disclosure, the floorcloth separator includes a first protrusion protruding from a first predetermined area of the upper surface of the docking unit such that a free end of the first protrusion is defined along the second direction, and a second protrusion protruding from a second predetermined area of the upper surface of the docking unit such that a free end of the second protrusion is defined along the second direction, and the first protrusion and the second protrusion are disposed to be spaced apart with a predetermined gap therebetween.

According to an embodiment of the disclosure, the docking unit includes a recessed area formed between the first protrusion and the second protrusion, and configured to be depressed based on a distance between the first protrusion and the second protrusion According to an embodiment of the disclosure, the docking station further includes a floorcloth attaching unit including a storage space formed so as to extend downward from the upper surface of the docking unit, within which a plurality of floorcloths are stackable, and an elastic support disposed on a lower part within the storage space and configured to push a plurality of floorcloths stacked within upwards.

According to an embodiment of the disclosure, the floorcloth attaching unit includes a fixing member arranged to limit, at the upper surface of the docking unit, an uppermost height of the plurality of floorcloths in the storage space being pushed upward by the elastic support.

According to an embodiment of the disclosure, the floorcloth separator is located upstream of the floorcloth attaching unit with respect to the first direction.

According to an embodiment of the disclosure, the docking station further includes a floorcloth recovery unit disposed inside the docking unit to accommodate the separated floorcloth entered into the docking unit through the opening.

According to an embodiment of the disclosure, the floorcloth recovery unit has a drawer shape configured to be drawn out from one side of the docking unit orthogonal to the upper surface of the docking unit.

According to an embodiment of the disclosure, the floorcloth recovery unit includes a cover configured with one end connected to the upper surface of the docking unit so as to be rotatable, and to open and close at least part of the upper surface of the docking unit by rotation of the cover.

According to an embodiment of the disclosure, a cleaning system includes a robot cleaner having a floorcloth unit to which a floorcloth is attachable, and a docking station corresponding to the robot cleaner. The docking station may include a docking unit including an upper surface forming a travel route along a first direction for the robot cleaner to move upon to enter the docking station; and a floorcloth separator including a protrusion, and configured so that the protrusion protrudes from a predetermined area of the upper surface of the docking unit such that a free end of the protrusion is defined along a second direction different from the first direction, and while the robot cleaner with a floorcloth attached to the floorcloth unit travels on the travel route along the first direction, at least a portion of the protrusion is inserted between the floorcloth unit and the floorcloth to separate the floorcloth from the floorcloth unit.

According to an embodiment of the disclosure, the protrusion has a wedge shape protruding from the predetermined area of the upper surface at an acute angle with respect to the upper surface of the docking unit.

According to an embodiment of the disclosure, the robot cleaner is configured to rotatably drive the floorcloth unit, while the floorcloth is being separated from the floorcloth unit by the protrusion.

According to an embodiment of the disclosure, the docking station includes a floorcloth attaching unit including a storage space formed so as to extend downward from the upper surface of the docking unit, within which a plurality of floorcloths are stackable, and an elastic support disposed on a lower part within the storage space and configured to push a plurality of floorcloths stacked within upwards.

According to an embodiment of the disclosure, the floorcloth unit is configured to move up and down within a predetermined distance along a height direction of the robot cleaner, and when the floorcloth unit is positioned above the floorcloth attaching unit with a floorcloth not being attached to the floorcloth unit, the robot cleaner is configured to move the floorcloth unit downward so that the floor unit comes into contact with an uppermost floorcloth among the plurality of floorcloths stacked in the floorcloth attaching unit.

According to an embodiment of the disclosure, the docking unit includes an opening formed so that at least part of the opening is located below the protrusion, and the floorcloth separated from the robot cleaner is entered into the docking unit through the opening as the robot cleaner moves over the protrusion.

According to an embodiment of the disclosure, the cleaning system further includes a floorcloth recovery unit disposed within the docking unit to accommodate the separated floorcloth entered into the docking unit through the opening.

According to an embodiment of the disclosure, a robot cleaner may include a floorcloth unit to which a floorcloth is detachably attachable; and a driving unit configured to rotate the floorcloth unit, wherein the driving unit is configured to rotate the floorcloth unit when detecting proximity to a predetermined structure for separating the floorcloth from the floorcloth unit while travelling in a state that the floorcloth is attached to the floorcloth unit.

According to an embodiment of the disclosure, a docking station for a cleaner may include a docking unit including an upper surface forming a travel route for a robot cleaner entering the docking station; and a floorcloth attaching unit formed to be recessed from the upper surface of the docking unit, the floorcloth attaching unit including a storage space in which a plurality of floorcloths can be stacked, and an elastic support disposed at a lower part within the storage space and configured to push a plurality of floorcloths stacked within upwards.

According to embodiments of the present disclosure, the floorcloth attached to the robot cleaner can be automatically replaced at the docking station without a need for a user directly to replace the floorcloth, thereby enhancing the user's convenience greatly.

The technical problems to be addressed in the present disclosure are not limited to those described herein, and other technical challenges not mentioned herein may be derived from the exemplary embodiments of the present disclosure by a person skilled in the art.

The effects that can be obtained from the exemplary embodiments of the present disclosure may be clearly derived and understood by those having ordinary knowledge in the technical field to which the embodiments of the disclosure belong, from the following description. That is to say, any unintended effects according to carrying out the exemplary embodiments of the disclosure may be clearly derived by those having ordinary knowledge in the art, from the exemplary embodiments of the disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION

Figure 1:
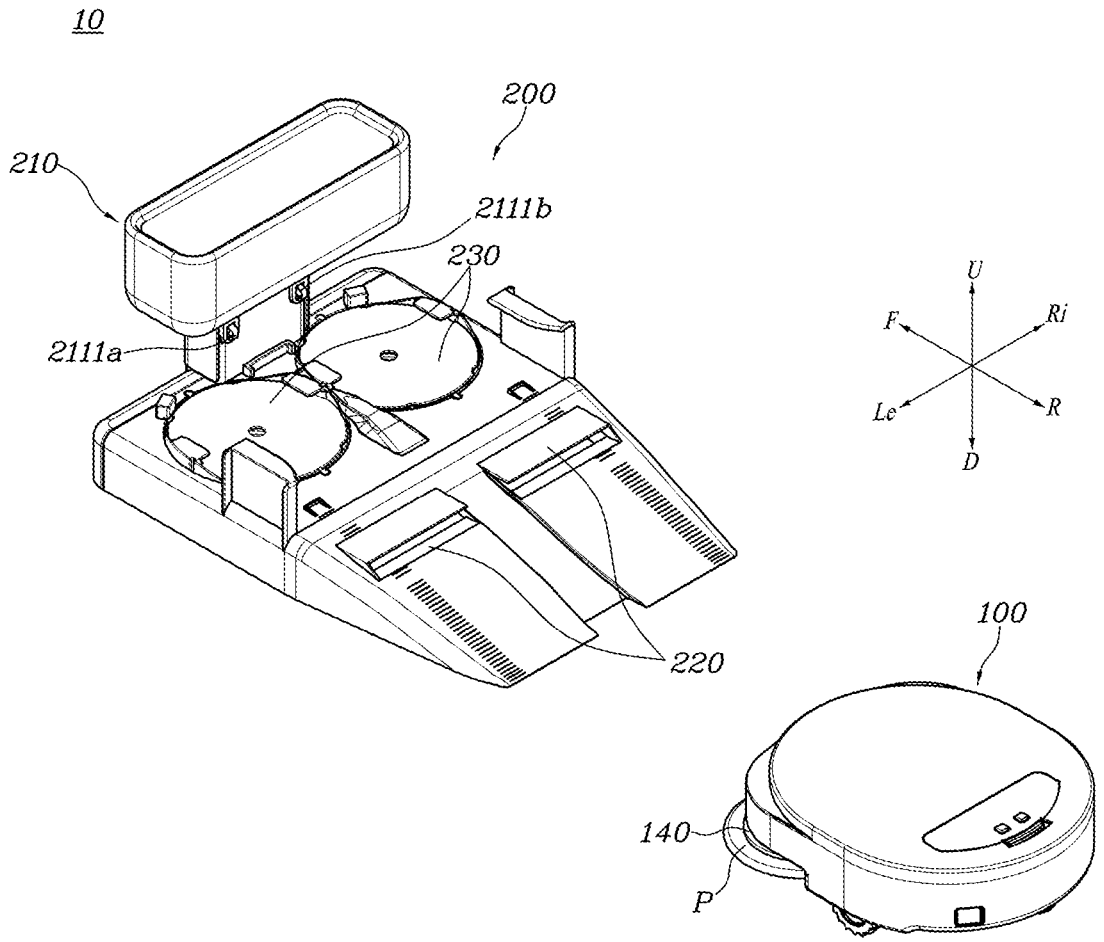
FIG. 1 is a diagram schematically illustrating a cleaning system according to an embodiment of the disclosure.

Hereinafter, various embodiments of the present disclosure will be described with reference to the drawings in such a detailed manner that those having ordinary knowledge in the technical field to which the disclosure pertains can easily implement the disclosed invention. However, the disclosure may be implemented in several different forms and is not limited to the embodiments described herein. In conjunction with the description of the drawings, like or similar reference numerals may be used for such like or similar components throughout the specification and the drawings. Further, in the drawings and their related descriptions, descriptions of well-known functions and configurations may be omitted for clarity and conciseness.

FIG. 1 is a diagram schematically illustrating a cleaning system according to an embodiment.

Referring to FIG. 1, a cleaning system 10 according to an embodiment may include a robot cleaner 100 and a docking station 200.

In an embodiment, the robot cleaner 100 may be in a state in which a floorcloth (P) (a damp floorcloth or a dry floorcloth) capable of contacting a surface to be cleaned (e.g., a floor surface) is attached to a floorcloth unit 140 at the bottom. The robot cleaner 100 can perform removing (or wiping) foreign substances attached to the surface to be cleaned using the floorcloth (P) attached to the floorcloth unit 140 at the bottom. For example, the robot cleaner 100 may rotate the floorcloth (P) attached to the bottom, and remove foreign substances attached to the floor surface, using frictional force between the floorcloth (P) and the floor surface generated according to the rotation of the floorcloth (P).

The robot cleaner 100 may enter the docking station 200 to replace the floorcloth (P) attached to the floorcloth unit 140. The robot cleaner 100 may enter the docking station 200 to charge a battery (e.g., a battery 150 of FIG. 3). A detailed configuration and operation of the robot cleaner 100 will be described later with reference to FIGS. 2 to 4.

In an embodiment, the docking station 200 may include a station housing 210 forming an overall appearance of the docking station 200. In an embodiment, the docking station 200 may include a floorcloth separator 220 (e.g., 220*a* and 220*b*) for supporting an automatic separation of the floorcloth (P) attached to the floorcloth unit 140 of the robot cleaner 100, without a user's intervention. In an embodiment, the docking station 200 may include a floorcloth attaching unit 230 that automatically supports attaching a fresh floorcloth to the floorcloth unit 140 of the robot cleaner 100 without a user's intervention. The docking station 200 may be configured to include a pair of charging terminals 2111*a* and 2111*b* for charging the battery 150 disposed in the robot cleaner 100. The detailed configuration and operation of the docking station 200 will be described later with reference to FIGS. 5 to 9.

Figure 2:
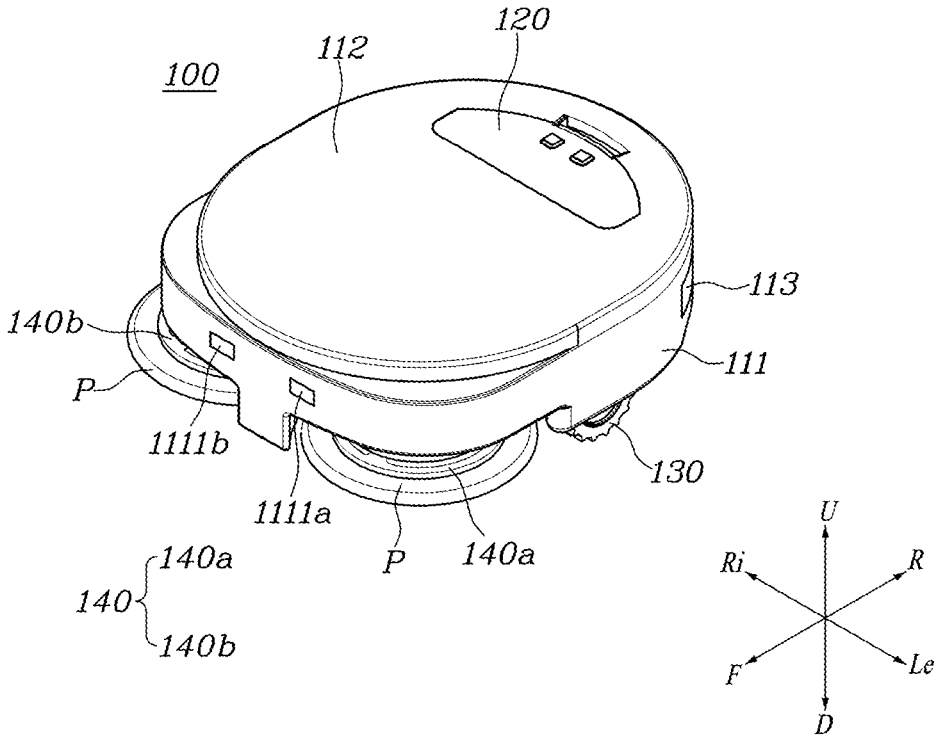
FIG. 2 is a perspective view of a robot cleaner according to an embodiment of the disclosure.
Figure 3:
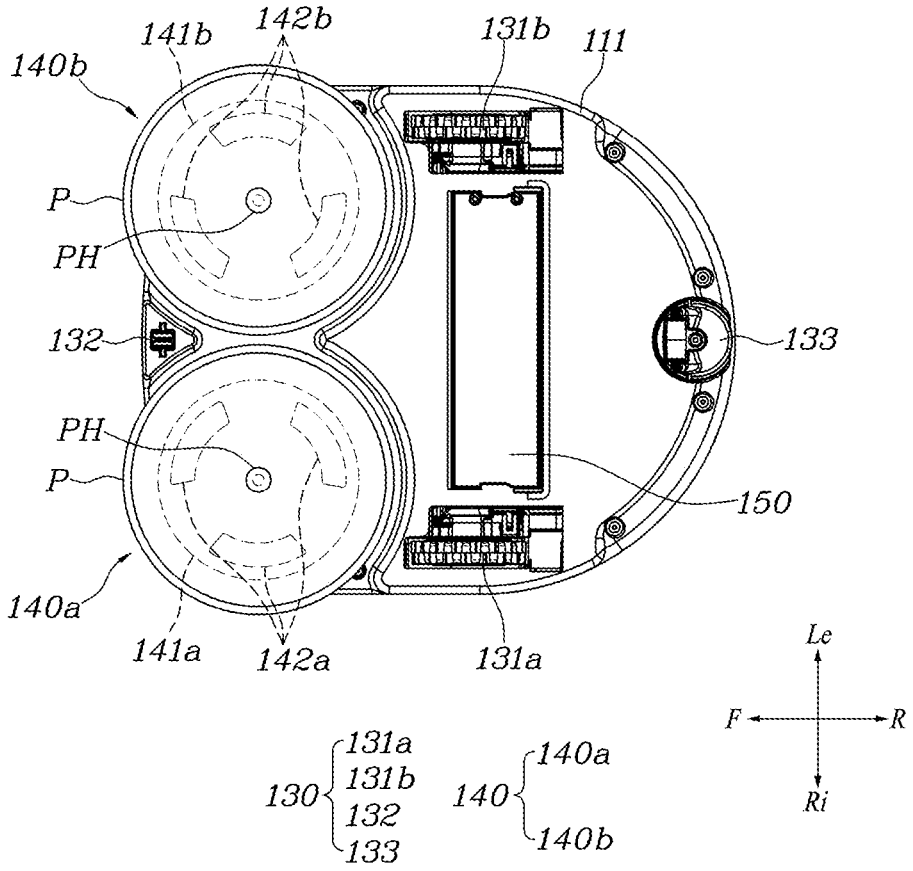
FIG. 3 is a bottom view of a robot cleaner according to an embodiment of the disclosure.

FIG. 2 is a perspective view of a robot cleaner according to an embodiment, and FIG. 3 is a rear view of a robot cleaner according to an embodiment.

Referring to FIGS. 2 and 3, in an embodiment, the robot cleaner 100 may include a cleaner body 111 and a cleaner cover 112. In an embodiment, the cleaner body 111 may form a lower and/or side appearance of the robot cleaner 100. According to an embodiment, a power button 113 may be disposed on one side of the cleaner body 111. According to an embodiment, the power button 113 may be turned on/off by a user to turn on/off the power of the robot cleaner 100. The cleaner cover 112 may form an upper exterior of the robot cleaner 100. The cleaner cover 112 may be coupled to an upper side of the cleaner body 111.

In an embodiment, the robot cleaner 100 may include a control panel 120 disposed on an upper surface of the cleaner cover 112. The control panel 120 may receive various commands related to the operation of the robot cleaner 100 from the user. According to an embodiment, the control panel 120 may provide a user with a current state of the operation of the robot cleaner 100.

According to an embodiment, the control panel 120 may include an input device such as buttons, switches, or touch panels. According to an embodiment, the robot cleaner 100 may receive a command related to the operation of the robot cleaner 100 (e.g., cleaning start/stop or changing cleaning mode) from the user via the input device of the control panel 120. According to an embodiment, the control panel 120 may include a display device such as a display. According to an embodiment, the robot cleaner 100 may display information about a current state of the robot cleaner 100 (e.g., current cleaning mode or battery state) to the user via the display device of the control panel 120. According to an embodiment, an input device and a display device may be integrally provided in the control panel 120, but the present disclosure is not limited thereto.

Referring to FIG. 3, in an embodiment, a travelling unit 130 may be disposed on a lower surface of the cleaner body 111. The robot cleaner 100 may move across a cleaning space by means of the travelling unit 130. The travelling unit 130 may be configured to enable free movement of the robot cleaner 100. The travelling unit 130 may include one or more wheels that receive power from a driving unit (not shown) provided within the robot cleaner 100 for rotation. According to an embodiment, the travelling unit 130 may include a pair of main wheels (e.g., a first main wheel 131*a* and a second main wheel 131*b*). In an embodiment, the first main wheel 131*a* and the second main wheel 131*b* may be disposed at both edges of the lower surface of the cleaner body 111 to support the body of the robot cleaner 100 while maintaining its balance. The travelling unit 130 may include a first sub-wheel 132 and a second sub-wheel 133. In an embodiment, each of the first sub-wheel 132 and the second sub-wheel 133 may be respectively disposed at the front and rear sides in a direction perpendicular to the direction in which the first main wheel 131*a* and the second main wheel 131*b* are disposed.

In an embodiment, a movement direction of the robot cleaner 100 may be determined according to how the movement of each of the first main wheel 131*a* and the second main wheel 131*b* is controlled. For example, the robot cleaner 100 may move forward or backward, when the first and second main wheels 131*a* and 131*b* are controlled to rotate in the same direction and speed, respectively. For example, when a pair of the main wheels 131*a* and 131*b* are respectively controlled to rotate in different directions and/or speeds, the robot cleaner 100 may move with changing its movement direction according to each designated condition.

In an embodiment, the first sub-wheel 132 may be disposed at the front side (e.g., in F direction) of the lower surface of the cleaner body 111. In an embodiment, the second sub-wheel 133 may be disposed at the rear side of the lower surface of the cleaner body 111 (e.g., in R direction). In an embodiment, the first sub-wheel 132 and the second sub-wheel 133 may support the robot cleaner 100 so as to maintain better balance while the robot cleaner 100 moves forward or backward, respectively.

In an embodiment, the floorcloth unit 140 may be disposed on the lower surface of the cleaner body 111. In an embodiment, the floorcloth unit 140 may be disposed in the front of the lower surface of the cleaner body 111, but the present disclosure is not limited thereto. A damp floorcloth (P) (or dry floorcloth) for wiping the floor surface may be detachably coupled to the floorcloth unit 140. The floorcloth unit 140 may rotate either clockwise or counterclockwise along with the damp floorcloth (P) attached to the floorcloth unit 140. When the floorcloth unit 140 rotates along with the damp floorcloth (P) attached thereto, friction may occur between the damp floorcloth (P) and the floor surface. With this friction, the robot cleaner 100 can remove foreign substances attached to the floor surface. In an embodiment, the floorcloth unit 140 may rise or fall within a predetermined distance in the height direction (or vertical direction) of the robot cleaner 100.

In an embodiment, the floorcloth unit 140 may include a first floorcloth unit 140*a* and a second floorcloth unit 140*b*. The first floorcloth unit 140*a* and the second floorcloth unit 140*b* may correspond to each other in terms of operation, structure, and shape. In an embodiment, the floorcloth unit 140 (e.g., the first floorcloth unit 140*a* and the second floorcloth unit 140*b*) may respectively include a rotating plate (e.g., a first rotating plate 141*a* or a second rotating plate 141*b*) and an attachment member (e.g., a first attachment member 142*a* or a second attachment member 142*b*). FIG. 2 shows that each rotating plate (141*a*, 141*b*) and each attachment member (142*a*, 142*b*) are covered by the damp floorcloth (P) attached to each floorcloth unit 140, but in order to indicate these components, each rotating plate (141*a*, 141*b*) and each attachment member (142*a* and 142*b*) are shown in dotted lines.

In an embodiment, the first and second rotating plates 141*a* and 141*b* may have a disk shape as a whole, but the disclosure is not limited to thereto. According to an embodiment, the diameter of the first rotating plate 141*a* may be configured to be equal to or smaller than that of the damp floorcloth (P), but the disclosure is not limited thereto. Similarly, the diameter of the second rotating plate 141*b* may be set equal to or smaller than that of the damp floorcloth (P), but the disclosure is not limited thereto.

Each corresponding attachment member, for example, the first attachment member 142*a* or the second attachment member 142*b*, may be disposed on one side of each of the first rotating plate 141*a* and the second rotating plate 141*b*. In an embodiment, the damp floorcloth (P) may be attached to each corresponding rotating plate (141*a*, 141*b*) by the first or second attachment member (142*a*, 142*b*). The first or second attachment member 142*a* or 142*b* may be, for example, a Velcro-type attachment means, and the present disclosure is not limited thereto. According to an embodiment, the first or second attachment members 142*a* and 142*b* may be divided into a plurality of segments, and the present disclosure is not limited thereto. In an embodiment, the first or second attachment members 142*a* and 142*b* may be configured of a plurality of segments spaced apart along a periphery of the rotating plates 141*a* and 141*b* by a predetermined interval in the circumferential direction.

In an embodiment, the battery 150 may be disposed in a lower part of the robot cleaner 100. In an embodiment, the battery 150 may be arranged to be detachable from the lower surface of the cleaner body 111 downward, but the present disclosure is not limited thereto. The battery 150 may be electrically connected to a driving unit such as a motor transmitting power to the travelling unit 130 and/or the floorcloth unit 140 so as to supply electric power to the driving unit. The battery 150 may be a rechargeable secondary battery, but the disclosure is not limited thereto. According to an embodiment, when a charging terminal provided in a front part of the robot cleaner 100 (e.g., a first charging terminal 1111*a* and/or a second charging terminal 1111*b*) and another charging terminal arranged in a main body 211 of the docking station 200 to be described later (e.g., a first charging terminal 2111*a* and/or a second charging terminal 2111*b*) come into contact with each other, the battery 150 may receive electric power from the docking station 200 for charging. In these drawings and their corresponding description, the battery 150 is illustrated and described as being charged using a contact charging method, but the present disclosure is not limited thereto. According to an embodiment, the battery 150 may be charged using a wireless charging scheme such as,p[ e.g., a magnetic induction charging. In such a case, a wireless charging structure (not shown) for wireless charging of the battery 150 may be provided in the robot cleaner 100 and the docking station 200, respectively.

Meanwhile, although not shown in FIGS. 2 and 3, the robot cleaner 100 may include a driving unit therein. In an embodiment, the driving unit may include, although not specifically shown in the drawings, a motor and/or an actuator, and further include a plurality of components for supplying power to the travelling unit 130 or the floorcloth unit 140. In an embodiment, the driving unit may be connected to the travelling unit 130, for example, the first and second main wheels 131*a* and 131*b*, respectively, to provide power required to move the robot cleaner 100. In an embodiment, the driving unit may be connected to the floorcloth unit 140 to provide power required to rotate each of the rotating plates 141*a* and 141*b*. In an embodiment, the driving unit may be connected to the floorcloth unit 140 to provide power required for raising and/or lowering the floorcloth unit 140 in the height (or vertical) direction.

Although not shown in FIGS. 2 and 3, the robot cleaner 100 may include therein a controller (e.g., a controller 170 of FIG. 4) generating control commands to control the operation of each part of the robot cleaner 100. Hereinafter, various control functions carried out by the controller according to an embodiment will be briefly described with reference to FIG. 4.

Figure 4:
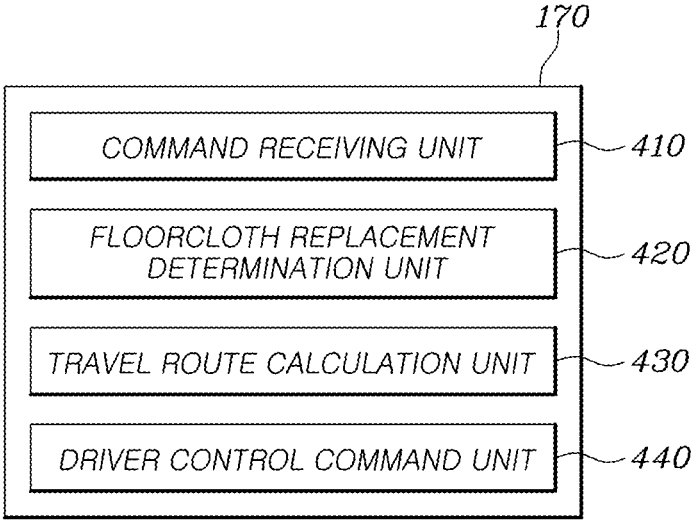
FIG. 4 is a diagram schematically showing functional blocks constituting a controller of a robot cleaner according to an embodiment of the disclosure.

FIG. 4 is a diagram schematically showing functional blocks constituting a controller of a robot cleaner according to an embodiment.

According to an embodiment, the controller 170 may include a command receiving unit 410. The command receiving unit 410 may receive commands from a user. The command receiving unit 410 may receive a command input from the user via the power button 113 and/or the control panel 120 described above. The command receiving unit 410 may receive a respective user command including, e.g., an operation on/off command, a cleaning start/pause command, a cleaning mode setting command, or the like.

In an embodiment, the controller 170 may include a floorcloth replacement determination unit 420 for determining whether or not the floorcloth attached to the floorcloth unit 140 should be replaced, while a cleaning of the robot cleaner 100 is in progress. In an embodiment, the floorcloth replacement determination unit 420 may determine whether or not to replace the floorcloth in use according to a result of detection of a contamination level sensor (not shown) provided separately. In an embodiment, the floorcloth replacement determination unit 420 may determine whether replacement of the floorcloth is required or not, according to a cleaning time duration that has elapsed after attaching the floorcloth to the floorcloth unit 140. In an embodiment, the floorcloth replacement determination unit 420 may determine whether replacement of the floorcloth is required or not, according to the command received from the command receiving unit 410.

In an embodiment, the controller 170 may include a travel route calculation unit 430 for calculating a travel route of the robot cleaner 100. In an embodiment, the travel route calculation unit 430 may calculate the travel route of the robot cleaner 100, based on a predetermined algorithm and/or a user command received through the command receiving unit 410. In an embodiment, the travel route calculation unit 430 may calculate the travel route by considering a result of detection from a sensor(s) (not shown) provided in the robot cleaner 100. In an embodiment, when the floorcloth replacement determination unit 420 determines that the floorcloth is required to be replaced, the travel route calculation unit 430 may calculate the travel route for driving the robot cleaner 100 to the docking station 200. In an embodiment, when it is determined that the battery 150 is required to be charged, the travel route calculation unit 430 may calculate the travel route for driving the robot cleaner 100 to the docking station 200.

In an embodiment, the controller 170 may include a driver control command unit 440. In an embodiment, the driver control command unit 440 may generate a control command for controlling each component of the driving unit (e.g., a motor and/or an actuator) to cause the robot cleaner 100 to travel according to the commands received from the user through the command receiving unit 410 and the travel route determined by the travel route calculation unit 430. In an embodiment, each component of the driving unit may operate according to a command generated by the driver control command unit 440. In an embodiment, each component of the driving unit may operate to appropriately control direction and speed of the rotation of the first and second main wheels 131*a* and 131*b*, according to the command generated by the driver control command unit 440, so that the robot cleaner 100 can appropriately travel in a required direction.

In an embodiment, the driver control command unit 440 may generate, based on the command received from the user through the command receiving unit 410, a control command to control each component of the driving unit, such as a motor and/or an actuator, to move the floorcloth unit 140. In an embodiment, according to the command generated by the driver control command unit 440, each component of the driving unit may operate to appropriately control the rotation speed of each rotating plate (141*a*, 141*b*) of the floorcloth unit 140. In such a circumstance, the intensity of wiping with the damp floorcloth of the robot cleaner 100 may be adjusted. In an embodiment, according to the command generated by the driver control command unit 440, each component of the driving unit may be controlled so that the floorcloth unit 140 rises or falls in the height direction. In this context, the distance between the floorcloth unit 140 and the floor may be adjusted.

Figure 5:
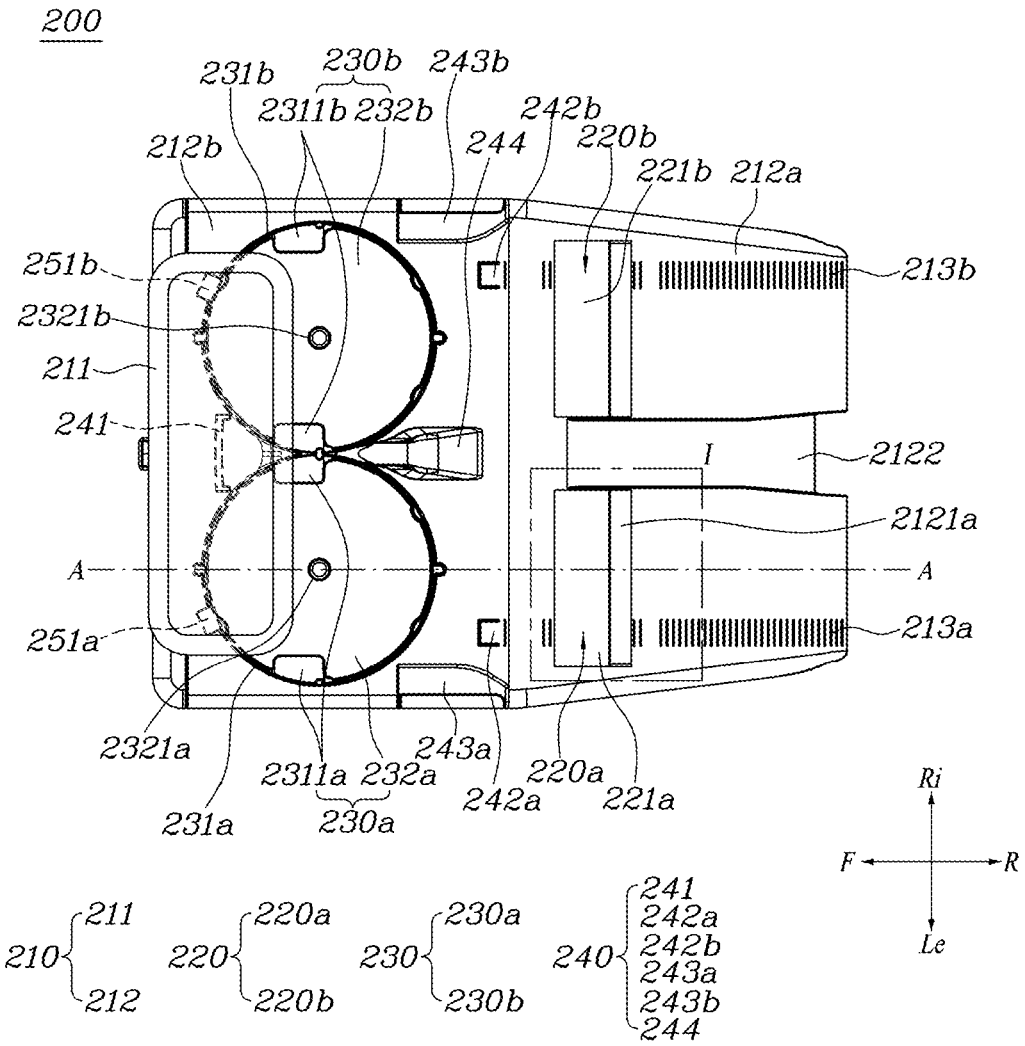
FIG. 5 is a plan view of a docking station according to an embodiment of the disclosure.
Figure 6:
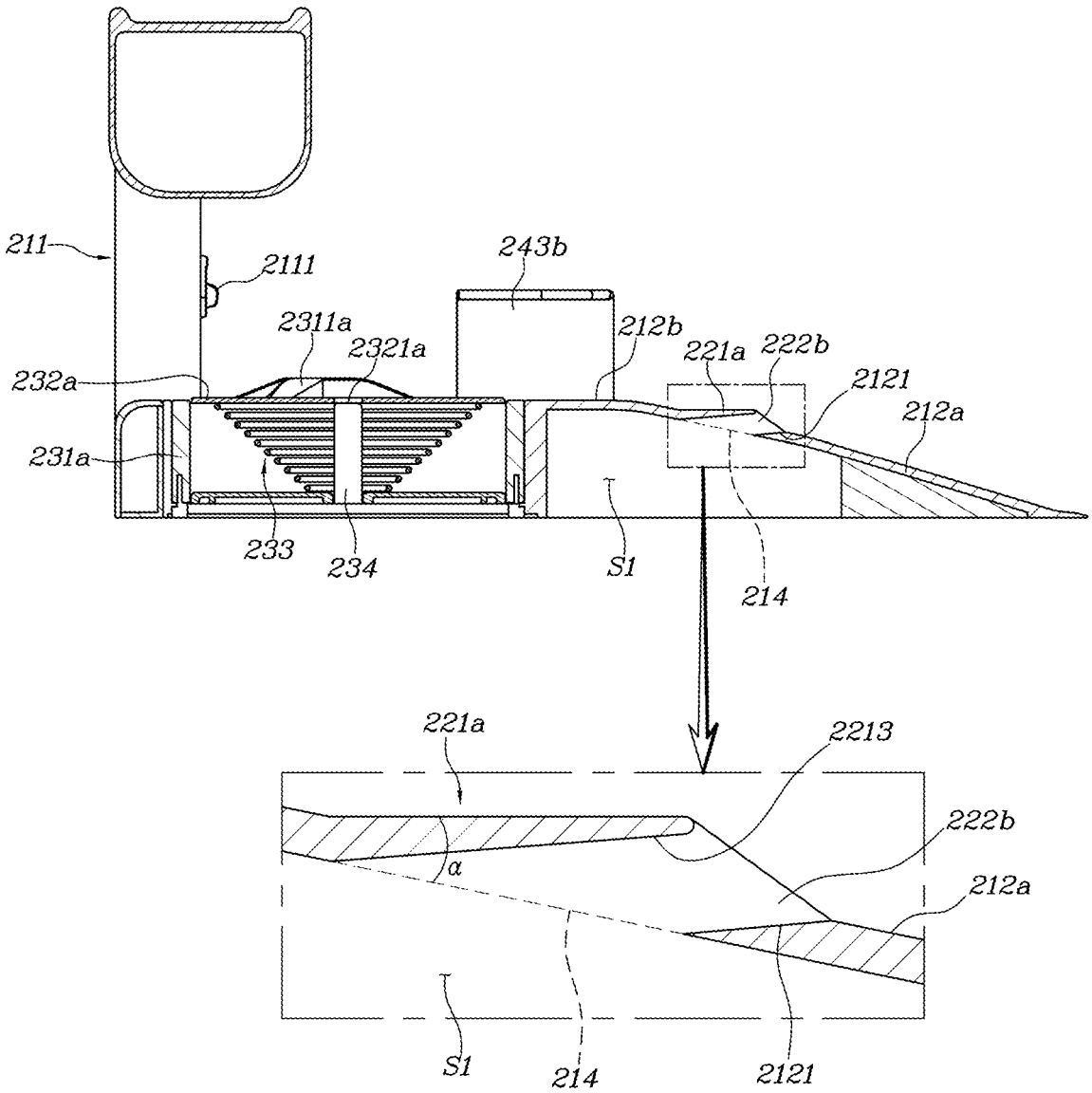
FIG. 6 is a cross-sectional view of a docking station according to an embodiment of the disclosure taken along line A-A in FIG. 5.

FIG. 5 is a plan view of a docking station according to an embodiment. FIG. 6 is a cross-sectional view of a docking station according to an embodiment, taken along line A-A in FIG. 5. And FIG. 7 is an enlarged view of part I shown in FIG. 5 as viewed from an upper side direction.

Figure 7:
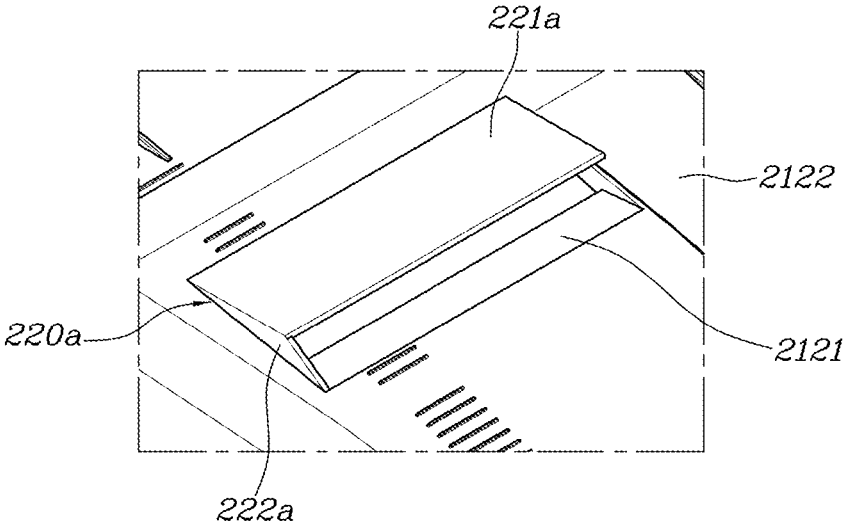
FIG. 7 is an enlarged view of part I shown in FIG. 5 as viewed from an upper side direction according to an embodiment of the disclosure.

Referring to FIGS. 5 to 7, in an embodiment, the docking station 200 may include a station housing 210. According to an embodiment, the station housing 210 may form the overall appearance of the docking station 200. According to an embodiment, the station housing 210 may include a main body 211 and a docking unit 212.

In an embodiment, the docking unit 212 may include a first portion 212*a* and a second portion 212*b* continuously extending from the first portion 212*a*. According to an embodiment, the first portion 212*a* and the second portion 212*b* of the docking unit 212 may be part of the travel route for the cleaner 100 approaching the docking station 200. According to an embodiment, on an upper surface of the first portion 212*a* and the second portion 212*b* may be formed a driving track for the robot cleaner 100 entering the docking station 200 to replace the damp floorcloth (P) or charge the battery 150, for example, a drive surface on which a pair of main wheels 131 provided in the robot cleaner 100 travels. According to an embodiment, on the upper surface of the first portion 212*a* and the second portion 212*b* may be formed the driving track for the robot cleaner 100 leaving the docking station 200 after replacing the damp floorcloth (P) and/or completing charging of the battery 150, for example, the drive surface on which the pair of main wheels 131 provided in the robot cleaner 100 travels. According to an embodiment, the first portion 212*a* may be located more upstream of the second portion 212*b* with respect to the travel route of the robot cleaner 100 entering the docking station 200. According to an embodiment, the upper surface of the first portion 212*a* may provide a first half of the travel route of the robot cleaner 100 entering the docking station 200. In an embodiment, the second portion 212*b* may be located downstream of the first portion 212*a* on the travel route of the robot cleaner 100 entering the docking station 200. According to an embodiment, the first portion 212*a* may include a ramp. In an embodiment, the first portion 212*a* may form an inclined surface that gradually ascends along a direction in which the robot cleaner 100 enters the docking station 200 (e.g., in F direction). In an embodiment, the second portion 212*b* continuously extending from the first portion 212*a* may form a flat surface without an inclination. In an embodiment, the flat surface of the second portion 212*b* may be disposed on an upper end of the inclined surface formed by the first portion 212*a*.

According to an embodiment, anti-slip members 213*a* and 213*b* may be disposed on the first portion 212*a*. In an embodiment, the anti-slip members 213*a* and 213*b* may be respectively disposed at both leftmost and rightmost edges of the first portion 212*a*. In an embodiment, the anti-slip members 213*a* and 213*b* may be disposed at positions corresponding to the travelling trajectory of the robot cleaner 100. According to an embodiment, a plurality of anti-slip members 213*a* and 213*b* may be provided. In an embodiment, each of the anti-slip members 213*a* and 213*b* may be disposed to be spaced apart from each other at a certain interval along a direction in which the inclination of the first portion 212*a* progresses (or along the travelling direction of the robot cleaner 100, e.g., F or R direction). According to an embodiment, the anti-slip members 213*a* and 213*b* may be configured to prevent the robot cleaner 100 moving along the first portion 212*a* from slipping. The anti-slip member 213 may be made of, for example, a material such as e.g., rubber.

In an embodiment, in the first portion 212*a* of the docking unit 212 may be disposed a first floorcloth separator 220*a* and a second floorcloth separator 220*b* that are spaced apart from each other with a predetermined interval therebetween. According to an embodiment, each of the first and second floorcloth separators 220*a* and 220*b* may include a first protrusion 221*a* or a second protrusion 221*b* protruding from a surface of the first portion 212*a*. The first protrusion 221*a* or the second protrusion 221*b* may be extended by a predetermined length along a direction (e.g., Le direction or Ri direction perpendicular to F or R direction) that is different from the travelling direction (e.g., the F or R direction) of the robot cleaner 100, wherein the predetermined length may correspond, for example, to the diameter of the floorcloth (P) attached to the robot cleaner 100. The respective extended directions and/or lengths of the first and second protrusions 221*a* and 221*b* may be either the same as or different from each other. In an embodiment, the first and second protrusions 221*a* and 221*b* may protrude at an acute angle with respect to the top surface of the first portion 212*a* to form a wedge shape. In an embodiment, an angle formed between the protrusion 221 and the top surface of the first portion 212*a* (e.g., angle a in FIG. 6) may fall within a range of approximately 30 degrees or less. Each angle between the first and second protrusions 221*a*and 221*b* and the top surface of the first portion 212*a* may be the same as or different from each other.

In an embodiment, the first floorcloth separator 220*a* may include a first side 222*a* connecting one side end of the corresponding first protrusion 221*a* (for example, one side end close to an edge of the first portion 212*a* in its width direction) and the top surface of the first portion 212*a*. In an embodiment, the second floorcloth separator 220*b* may include a second side 222*b* connecting one side end of the corresponding second protrusion 221*b* (for example, one side end close to an edge of the first portion 212*a* in its width direction, that is, one side end opposite to the first side 222*a*) and the top surface of the first portion 212*a*. According to an embodiment, an opening 214 that is opened upward may be formed at each position corresponding to each of the first and second protrusions 212*a* and 212*b* on the top surface of the first portion 212*a*. According to an embodiment, each corresponding opening 214 may be formed below each of the first and second protrusions 212*a* and 212*b*. In an embodiment, the opening 214 may extend in the same direction as each corresponding first or second protrusion 212*a* or 212*b*, and the present disclosure is not limited thereto. According to an embodiment, each of the first and second protrusions 221*a* and 221*b* may be configured to cover at least part of the opening 214 at its respective corresponding position from above. In an embodiment, at least part of the corresponding opening 214 may be disposed in a space formed by the first protrusion 221*a* and the first side portion 222*a*. In an embodiment, at least part of the corresponding opening 214 may be disposed in a space formed by the second protrusion 221*b* and the second side portion 222*b*. As will be described later, at least a portion of the damp floorcloth (P) separated from the robot cleaner 100 by the first and/or second protrusions 221*a* and 221*b* may be inserted through each opening 214. In an embodiment, the first portion 212*a* of the docking unit 212 may include a recovery space (S1) in which the damp floorcloth (P) separated from the robot cleaner 100 is accommodated, on an inner part below the top surface provided with the drive surface for the robot cleaner 100. In an embodiment, the opening 214 may communicate with the recovery space (S1). As will be described later, the damp floorcloth (P) separated from the robot cleaner 100 by the first and/or second protrusions 221*a* and 221*b* may be accommodated into the recovery space (S1) through each opening 214.

According to an embodiment, as shown in the enlarged portion of FIG. 6, on the first portion 212*a*, an area adjacent to a free end of the first protrusion 221*a* and its lower opening 214 along the direction entering into the docking station 200 (e.g., in the F direction), for example, an inner end 2121 of the first portion 212*a*, may be formed to be inclined downward, facing the lower surface 2213 of the first protrusion 221*a* toward the opening 214. According to an embodiment, the inner end 2121 of the first portion 212*a* may be configured to have a surface parallel to the lower surface 2213 of the first protrusion 221*a*. Although FIG. 6 illustrates only the opening 214 and the inner end 2121 facing the first protrusion 221*a*, the corresponding opening 214 and inner end 2121 also in relation to the second protrusion 221*b* may be configured to have the same or similar configuration, according to an embodiment.

According to an embodiment, the first portion 212*a* of the docking unit 212 may include, in its middle, a recessed region 2122 that is more concave downward than a part providing the drive surface on which each of the main wheels 131 of the robot cleaner 100 passes. In an embodiment, the first floorcloth separator 220*a* and the second floorcloth separator 220*b* may be arranged to be spaced apart from each other on the first portion 212*a* with the above recessed area 2122 therebetween. When the robot cleaner 100 moves along the drive surface of the first portion 212*a*, the first sub-wheel 132 of the robot cleaner 100 may pass between the first floorcloth separator 220*a* and the second floorcloth separator 220*b* through the recessed area 2122 formed in between the first floorcloth separator 220*a* and the second floorcloth separator 220*b*. In the present disclosure, description is mainly made of an embodiment in which a pair of floorcloth separators, that is, the first floorcloth separator 220*a* and the second floorcloth separator 220*b* are arranged, in the first portion 212*a*, spaced apart from each other with the recessed area 2122 interposed therebetween, but the present disclosure is not limited thereto. In an embodiment, only one continuous floorcloth separator may be formed in the first portion 212*a*. In an embodiment, a separate recessed area 2122 may not be formed in between a plurality of floorcloths separators formed in the first portion 212*a*.

According to an embodiment, the second portion 212*b* of the docking unit 212 may include a first floorcloth attaching unit 230*a* and a second floorcloth attaching unit 230*b* disposed side by side with each other on the second portion 212*b*. According to an embodiment, each of the first floorcloth attaching unit 230*a* and the second floorcloth attaching unit 230*b* may include a first floorcloth container 231*a* or a second floorcloth container 231*b* formed with a recess in its respective corresponding region. According to an embodiment, each of the first or second floorcloth containers 231*a* and 231*b* may be formed to have an upper side open and have a hollow cylindrical shape, but the present disclosure is not limited thereto. According to an embodiment, the first or second floorcloth container 231*a* or 231*b* may accommodate therein one or more unused damp floorcloths (P), respectively. In an embodiment, a plurality of unused damp floorcloths (P) may be stacked in a vertical direction inside the first or second floorcloth container 231*a* or 231*b*.

According to an embodiment, the second portion 212*b* may include a pair of floorcloth ribs 2311*a* or another pair of floorcloth ribs 2311*b* arranged to face each other at an edge of a top surface of each floorcloth container for the first or second floorcloth container 231*a* or 231*b*. According to an embodiment, each floorcloth rib pair 2311*a* or 2311*b* may be disposed on top of the unused damp floorcloths (P) stacked in the corresponding floorcloth container (231*a*, 231*b*), so as to prevent the damp floorcloth (P) exposed to the outside from leaving each floorcloth container (231*a*, 231*b*). According to an embodiment, each floorcloth rib pair 2311*a* or 2311*b* may be disposed at both sides of the upper edge of the corresponding floorcloth container (231*a*, 231*b*). According to an embodiment, each floorcloth rib pair 2311*a* or 2311*b* may be configured in a form bending in a direction opposite to the top surface of the corresponding floorcloth container (231*a*, 231*b*), subsequently to extending upward from the edge of the top surface of the corresponding floorcloth container (231*a*, 231*b*).

According to an embodiment, a guide shaft 234 may be disposed at the inner center of each of the floorcloth containers 231*a* and 231*b*. According to an embodiment, the guide shaft 234 may be disposed on a bottom surface of each of the floorcloth containers 231*a* and 231*b*. According to an embodiment, the guide shaft 234 may be formed extending upward from the bottom surface of the floorcloth containers 231*a* and 231*b*. According to an embodiment, each guide shaft 234 may be formed to pass through a guide hole 2321*a* or 2321*b* of each corresponding floorcloth tray 232*a* or 232*b* and a hole (e.g., a damp floorcloth hole PH of FIG. 3) of each damp floorcloth (P) stacked on the corresponding floorcloth tray 232*a* or 232*b*, as will be described later. In an embodiment, each guide shaft 234 may guide the unused damp floorcloths (P) stacked in each corresponding floorcloth container 231*a* or 231*b* to be kept in place within the corresponding floorcloth container 231*a* or 231*b*.

According to an embodiment, the floorcloth trays 232*a* and 232*b* may be respectively accommodated in each of the floorcloth containers 231*a* and 231*b*. According to an embodiment, each floorcloth tray 232*a* or 232*b* may have a disk shape as a whole. According to an embodiment, the guide holes 2321*a* and 2321*b* through which the guide shaft 234 passes may be respectively formed at the center of each of the floorcloth trays 232*a* and 232*b*.

According to an embodiment, the unused damp floorcloths (P) may be accommodated in the respective corresponding floorcloth containers 231*a* and 231*b*, being vertically stacked on each of the floorcloth trays 232*a* and 232*b*.

According to an embodiment, a floorcloth support 233 may be disposed underneath the floorcloth trays 232*a* and 232*b*. According to an embodiment, each floorcloth support 233 may be arranged to surround each corresponding guide axis 234.

According to an embodiment, each floorcloth support 233 may be configured to elastically support each corresponding floorcloth tray 232*a* or 232*b* from bottom upward. In an embodiment, the floorcloth support 233 may include an elastic member such as a spring with a certain elastic force. In such a case, the elastic member of the floorcloth support 233 may be stretched/compressed by the load of the damp floorcloths (P) stacked on each of the floorcloth trays 232*a* and 232*b*. In an embodiment, the elastic force of the elastic member of the floorcloth support 233 may be set so that the unused damp floorcloth (P) located on the uppermost side is positioned side by side on the top surface of the second portion 212*b*, even when all the unused damp floorcloths (P) capable of being accommodated in the corresponding floorcloth tray (232*a*, 232*b*) are stacked, and the present disclosure is not limited thereto.

According to an embodiment, the docking station 200 may include one or more guide members for guiding the robot cleaner 100 to travel on a correct track of the travel surface of the docking unit 212 to properly arrive at a designated position for attaching the floorcloth and/or charging the battery.

According to an embodiment, a pair of guide grooves 242*a* and 242*b* may be disposed at a position where the first portion 212*a* and the second portion 212*b* of the docking unit 212 are connected with each other. According to an embodiment, the guide grooves 242*a* and 242*b* may be disposed at an edge in the width direction of the second portion 212*b*, for example, at an outer position through which each of the main wheels 131 on both sides of the robot cleaner 100 passes.

According to an embodiment, the guide grooves 242*a* and 242*b* may guide the robot cleaner 100 to be positioned in place onto the floorcloth attaching unit 230*a* or 230*b*. In an embodiment, when the movement of the robot cleaner 100 is restricted by a wheel stopper 241 as will be described later, the robot cleaner 100 may be fixedly disposed on the second portion 212*b* as each of the main wheels 131*a* and 131*b* of the robot cleaner 100 is seated on the guide grooves 242*a* and 242*b*.

According to an embodiment, the guide grooves 242*a* and 242*b* may be formed to protrude from the top surface of the second portion 212*b* to surround at least a portion of the main wheels 131 of the robot cleaner 100. According to an embodiment, the guide grooves 242*a* and 242*b* may be formed recessed from the top surface of the second portion 212*b* to surround at least a portion of the main wheels 131 of the robot cleaner 100.

According to an embodiment, the docking unit 212 may include a pair of guide ribs 243*a* and 243*b* as one of the guide members for guiding the robot cleaner 100 to travel on the correct track of the drive surface of the docking unit 212 to properly reach the designated correct position for attaching the floorcloth and/or charging the battery. In an embodiment, each of the guide ribs 243*a* and 243*b* may be disposed in a position of the second portion 212*b* adjacent to the first portion 212*a*. According to an embodiment, each of the guide ribs 243*a* and 243*b* may be disposed at both edges of the second portion 212*b* in the width direction. According to an embodiment, each of the guide ribs 243*a* and 243*b* may be formed extending vertically from the top surface of the second portion 212*b* and then bending inward. According to an embodiment, each of the guide ribs 243*a* and 243*b* can prevent the robot cleaner 100 traveling along the drive surface of the docking unit 212 from falling out of the docking station 200.

According to an embodiment, the docking unit 212 may include an anti-collision unit 244 as one of the guide members for guiding the robot cleaner 100 to travel on the correct track of the drive surface of the docking unit 212 to properly reach the designated position for attaching the floorcloth and/or charging the battery. In an embodiment, the anti-collision unit 244 may be disposed on the path, on the top surface of the second portion 212*b*, passing before reaching the proper position of the floorcloth attaching units 230*a* and 230*b*, where the robot cleaner 100 entering the docking station 200 has reached the vicinity of the floorcloth attaching units 230*a* and 230*b* on both sides. In an embodiment, the anti-collision unit 244 may be formed to be inclined upward along the travelling direction of the robot cleaner 100 traveling toward the floorcloth attaching units 230*a* and 230*b*. In an embodiment, the height from the top surface of the second portion 212*b* of the anti-collision part 244 may be set equal to the height of the floorcloth ribs 2311*a* and 2311*b*. According to an embodiment, the anti-collision unit 244 may serve to prevent the first sub-wheel 132 from colliding with the floorcloth ribs 2311*a* and 2311*b*, when the robot cleaner 100 enters above each of the floorcloth attaching units 230*a* and 230*b*, the first sub-wheel 132 moves over the floorcloth ribs 2311*a* and 2311*b* to avoid collisions. As the robot cleaner 100 traveling on the top surface of the second portion 212*b* passes through the floorcloth ribs 2311*a* and 2311*b* to reach a wheel stopper 241, avoiding a collision with the floorcloth ribs 2311*a* and 2311*b* by means of the anti-collision part 244, the robot cleaner 100 may be seated in the correct position of the floorcloth attaching unit 230.

According to an embodiment, the wheel stopper 241 may be disposed on the second portion 212*b* at a position farther away from the first portion 212*a*. In an embodiment, the wheel stopper 241 may be located in between the main body 211 and the floorcloth attaching units 230*a* and 230*b*. In an embodiment, the wheel stopper 241 may be configured to enclose at least a portion of the first sub-wheel 132 of the robot cleaner 100. According to an embodiment, the wheel stopper 241 may guide the robot cleaner 100 to be positioned in place at each of the floorcloth attaching units 230*a* and 230*b*. For example, when the first sub-wheel 132 of the robot cleaner 100 comes into contact with the wheel stopper 241 while the robot cleaner 100 is traveling on the second portion 212*b*, the robot cleaner 100 may be caused to not move any longer and be located on the floorcloth attaching units 230*a* and 230*b*.

According to an embodiment, floorcloth stoppers 251*a* and 251*b* may be arranged adjacent to the upper edge of each of the floorcloth attaching units 230*a* and 230*b*, on the second portion 212*b* of the docking unit 212. According to an embodiment, each of the floorcloth stoppers 251*a* and 251*b* may be formed to protrude upward from the top surface of the second portion 212*b*. According to an embodiment, each of the floorcloth stoppers 251*a* and 251*b* can prevent the unused damp floorcloth (P) accommodated in the corresponding floorcloth attaching units 230*a* and 230*b* from leaving the floorcloth attaching units 230*a* and 230*b*. For example, while the robot cleaner 100 enters above the floorcloth attaching units 230*a* and 230*b*, at least a portion of the unused damp floorcloth (P) exposed to the outside, disposed at the top side of the floorcloth attaching units 230*a* and 230*b* may come into contact with the robot cleaner 100. At this time, the unused damp floorcloth (P) in contact with the robot cleaner 100 may be pushed in a direction that could move the unused damp floorcloth (P) out of the damp floorcloth attaching unit 230 along the moving direction of the robot cleaner 100 by the power of the robot cleaner 100. In preparation for such a case, the floorcloth stopper (251*a*, 251*b*) may limit such a movement of the unused damp floorcloth (P), thereby preventing the unused damp floorcloth (P) from leaving the floorcloth attaching unit 230.

According to an embodiment, the main body 211 may be coupled to the docking unit 212. According to an embodiment, the main body 211 may be disposed on one side of the second portion 212*b* of the docking unit 212. According to an embodiment, the main body 211 may be located on one side at a position far away from the first portion 212*a*, in the second portion 212*b* of the docking unit 212. According to an embodiment, a charging terminal 2111 configured to be in contact with charging terminals 1111*a* and 1111*b* of the robot cleaner 100 may be provided below the main body 211. In an embodiment, the charging terminal 2111 may be disposed in one surface (e.g., in R direction) of the main body 211 facing the robot cleaner 100, in a state that the robot cleaner 100 is seated in a correct position for charging a battery in the second portion 212*b*.

Figure 8:
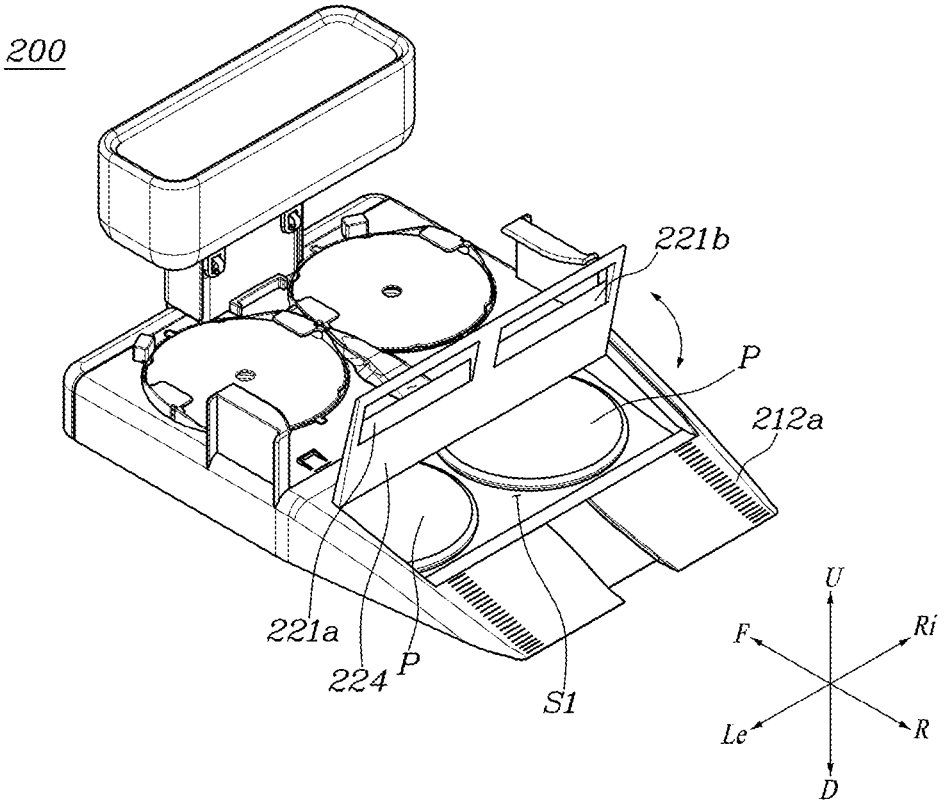
FIG. 8 is a diagram illustrating a cover-type damp-cloth recovery structure of a docking station according to an embodiment of the disclosure.

FIG. 8 is a perspective view illustrating a cover-type of damp floorcloth recovery structure of a docking station according to an embodiment. And FIG. 9 is a perspective view illustrating a drawer-type of damp floorcloth recovery structure of a docking station according to an embodiment.

Referring to FIG. 8, in an embodiment, a portion of the first portion 212*a* of the docking unit 212 may form a cover plate 224 for collecting a floorcloth. According to an embodiment, the cover plate 224 may include a hinge (not shown) extending from a top surface of the first portion 212*a* in a direction (e.g., Le direction or Ri direction) perpendicular to the entry direction (e.g., F direction) of the robot cleaner 100. According to an embodiment, the cover plate 224 may be rotatably coupled to the first portion 212*a* about a hinge (not shown). According to an embodiment, the floorcloth separators 220*a* and 220*b* may include, for example, the protrusions 221*a* and 221*b* and the side portions 222*a* and 222*b*, and the opening 214 integrally provided on the cover plate 224.

According to an embodiment, as the cover plate 224 rotates about the hinge, the recovery space (S1) in which the damp floorcloth (P) separated from the robot cleaner 100 is accommodated may be opened and closed. For example, as shown in FIG. 8, when the cover plate 224 rotates counterclockwise, the recovery space (S1) may be opened to be exposed to the outside, and the user may receive the damp floorcloth (P) accommodated in the recovery space (S1). For example, as shown in FIG. 8, when the cover plate 224 rotates clockwise, the recovery space (S1) may be blocked from the outside, and the damp floorcloth (P) attached to the lowermost part of the robot cleaner 100 traveling along the first portion 212*a* may be separated by the floorcloth separators 220*a* and 220*b* provided on the cover plate 224 to be accommodated in the recovery space (S1).

Figure 9:
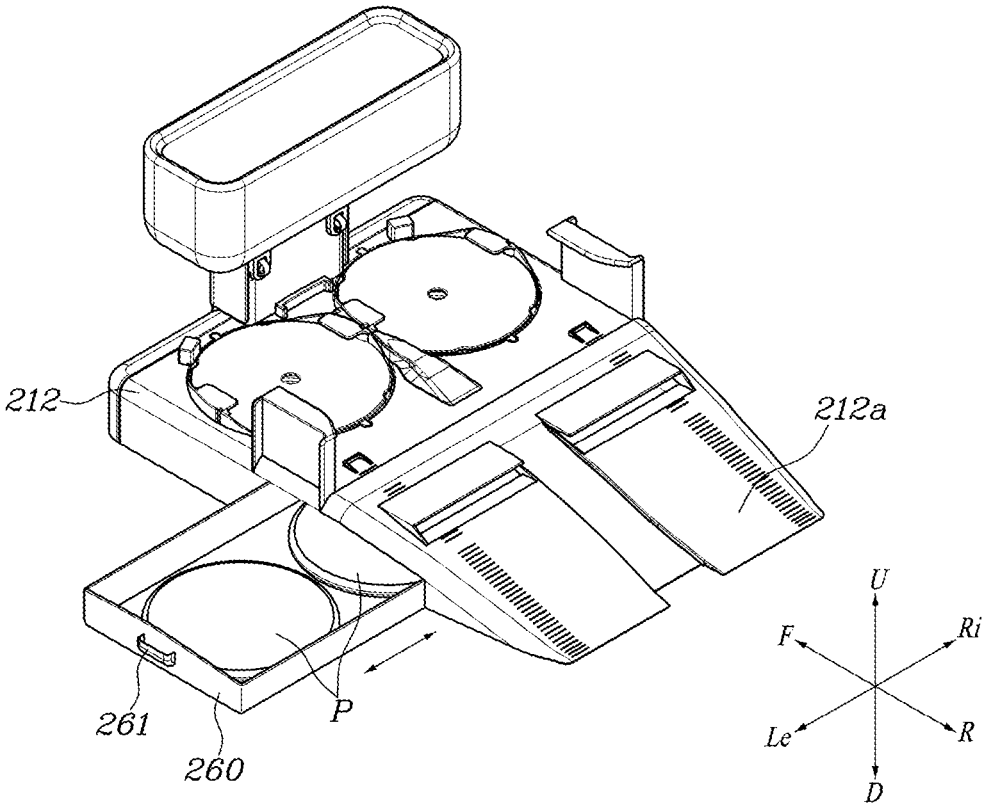
FIG. 9 is a view illustrating a drawer-type damp-cloth recovery structure of a docking station according to an embodiment of the disclosure.

Referring to FIG. 9, in an embodiment, a floorcloth drawer 260 may be provided on one side of the docking unit 212. According to an embodiment, underneath the first portion 212*a* and the second portion 212*b* of the docking unit 212 may be disposed a floorcloth drawer 260 that can be drawn from the side. According to an embodiment, the floorcloth drawer 260 may be accommodated in the recovery space S1 for collecting the damp floorcloth underneath the floorcloth separators 220*a* and 220*b*. According to an embodiment, the floorcloth drawer 260 may be configured to accommodate the damp floorcloth (P) separated from the floorcloth separators 220*a* and 220*b*. According to an embodiment, the floorcloth drawer 260 may be provided to be drawn out from one side of the docking unit 212. According to an embodiment, a handle 261 for gripping by a user may be disposed on one side of the floorcloth drawer 260.

In such a circumstance, the user can collect the damp floorcloth (P) accommodated in the floorcloth drawer 240 by gripping the handle 261 and pulling out the floorcloth drawer 240 to the outside.

Figure 10A:
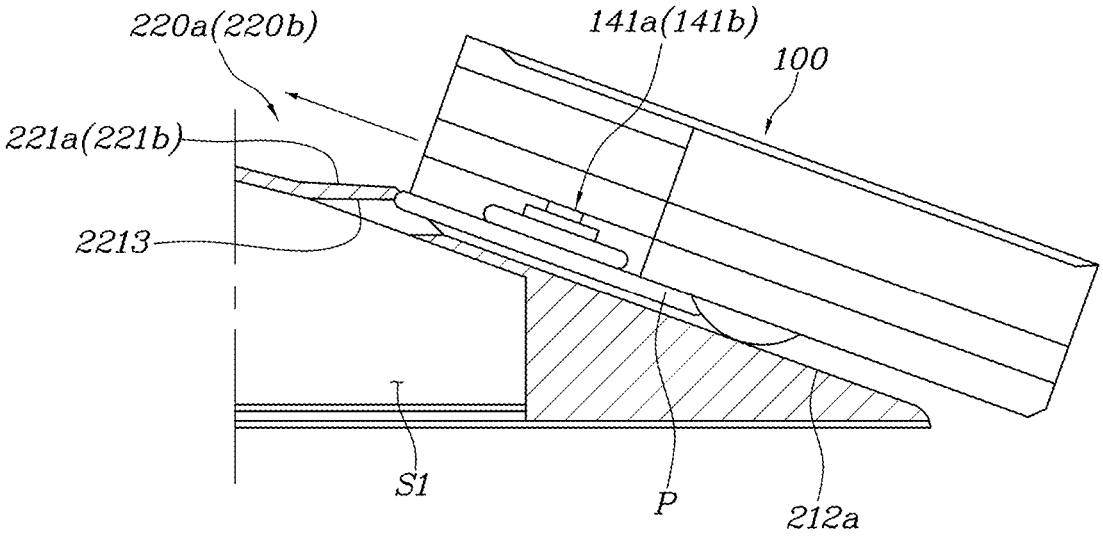
FIGS. 10A and 10B are exemplary diagrams illustrating situations in which a damp floorcloth is separated from a robot cleaner while passing through a floorcloth separator of a docking station, according to an embodiment of the disclosure.
Figure 10B:
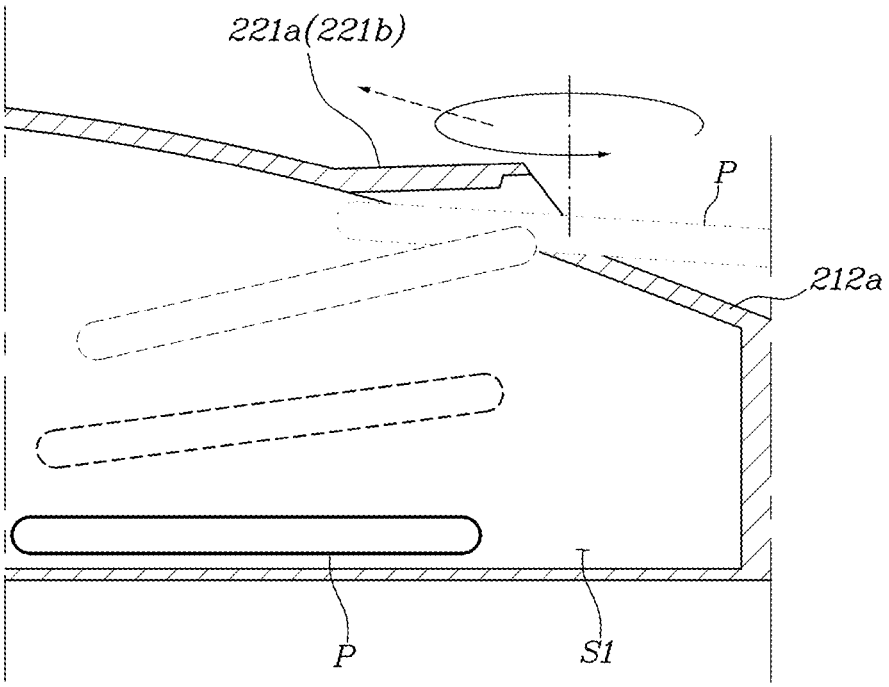

FIGS. 10A and 10B are exemplary diagrams illustrating situations in which a damp floorcloth is separated from a robot cleaner while passing through a floorcloth separator of a docking station, according to an embodiment.

FIG. 10A shows a state in which the robot cleaner 100 enters the docking station and travels on the first portion 212*a*, reaching the floorcloth separators 220*a* and 220*b*. As shown therein, the protrusions 221*a* and 221*b* of the floorcloth separators 220*a* and 220*b* are formed to protrude from the top surface of the first portion 212*a* at a predetermined acute angle with respect to the top surface of the first portion 212*a*. As shown in FIG. 10A, free free ends of the protrusions 221*a* and 221*b* of the floorcloth separators 220*a* and 220*b* are located at an edge between the robot cleaner 100 and the damp floorcloth (P) attached thereto. Although not explicitly shown in FIG. 10A, thereafter, when the robot cleaner 100 continues to travel along the entry direction (direction of the arrow), the sharp free free ends of the protrusions 221*a* and 221*b* may penetrate into between the robot cleaner 100 and the top surface of the damp floorcloth (P) attached thereto. Subsequently, the lower surface 2213 of the protrusions 221*a* and 221*b* comes into contact with the top surface of the damp floorcloth (P), and the damp floorcloth (P) attached to the robot cleaner 100 may be separated from the robot cleaner 100 by the frictional force generated according to such contact. According to an embodiment, the robot cleaner 100 may operate to rotate the rotating plates 141*a* and 141*b*, when it detects proximity to or contact with the protrusions 221*a* and 221*b* during its travelling. In such a case, in addition to the driving force of the robot cleaner 100 traveling in the entry direction, the robot cleaner 100 may more easily separate the damp floorcloth (P) attached to its lowermost part, by the rotational force of the rotating plates 141*a* and 141*b*. According to an embodiment, the docking station 200 can separate the damp floorcloth (P) attached to the robot cleaner 100, using only the power of the robot cleaner 100 (e.g., linear power and/or rotational poser), even without provision of any separate self-power, through the protrusions 221*a* and 221*b* of the floorcloth separators 220*a* and 220*b*.

According to an embodiment, the damp floorcloth (P) separated from the lowermost part of the robot cleaner 100 by the protrusions 221*a* and 221*b* may be inserted beneath the lower surface of the protrusions 221*a* and 221*b*. Thereafter, the damp floorcloth (P) separated from the robot cleaner 100 may be introduced into and accommodated in the recovery space (S1) provided inside the first portion 212*a* of the docking station 200, through the opening 214 formed beneath the lower surface of the protrusions 221*a* and 221*b*. In FIG. 10B is shown a movement path in which the damp floorcloth (P) separated from the robot cleaner 100 is introduced into the recovery space (S1) and accommodated therein.

Figure 11A:
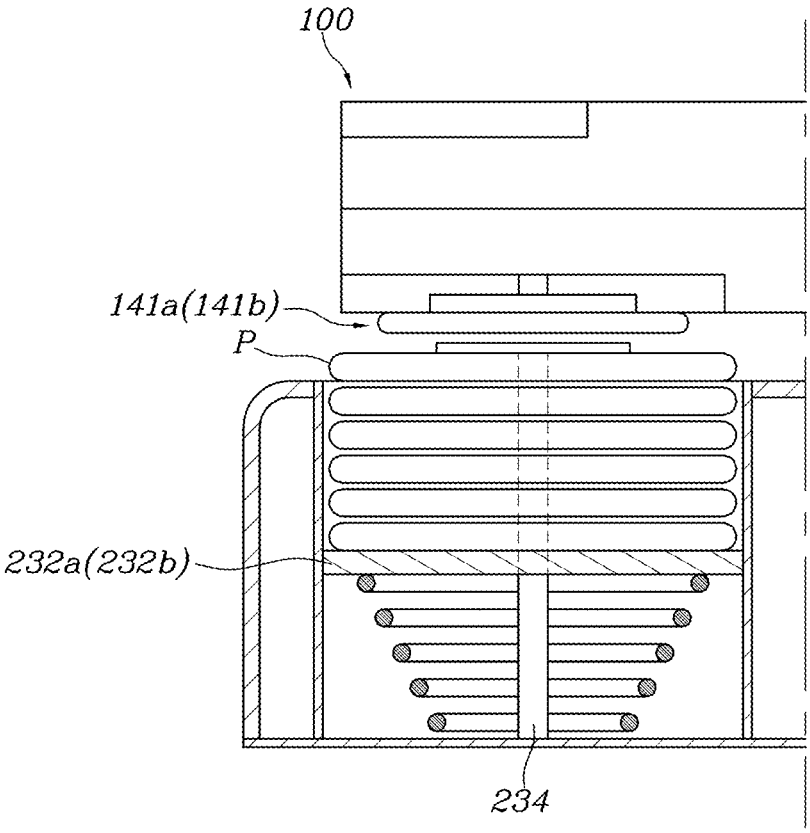
FIGS. 11A to 11C are exemplary diagrams illustrating a change in situation when a damp floorcloth is attached to a robot cleaner at a floorcloth attaching unit of a docking station, as viewed from a side direction, according to an embodiment of the disclosure.
Figure 11B:
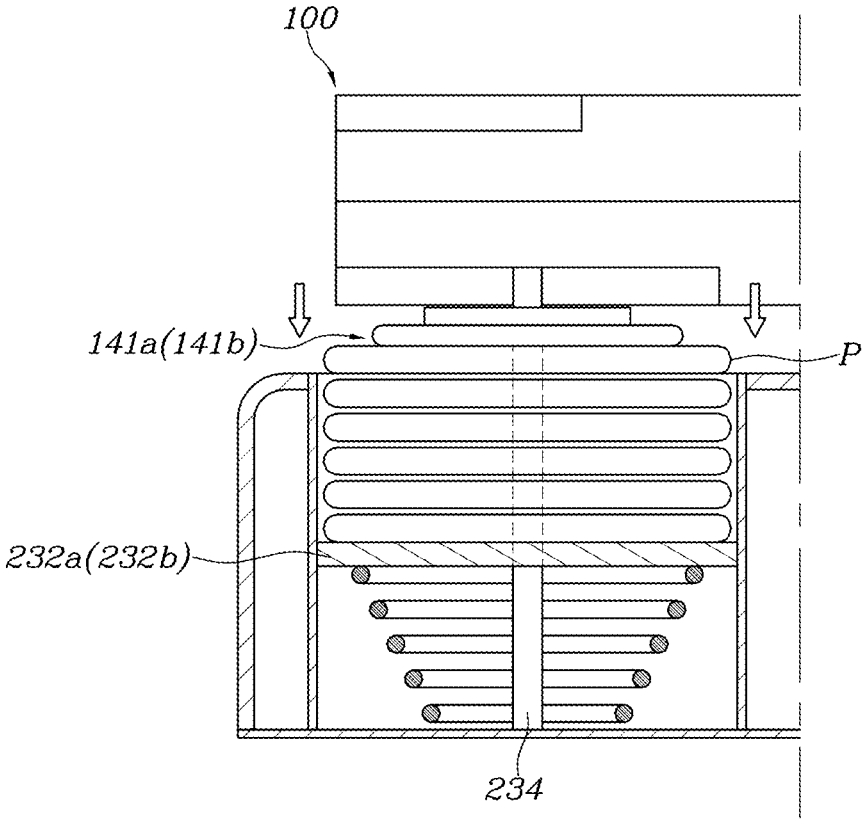
Figure 11C:
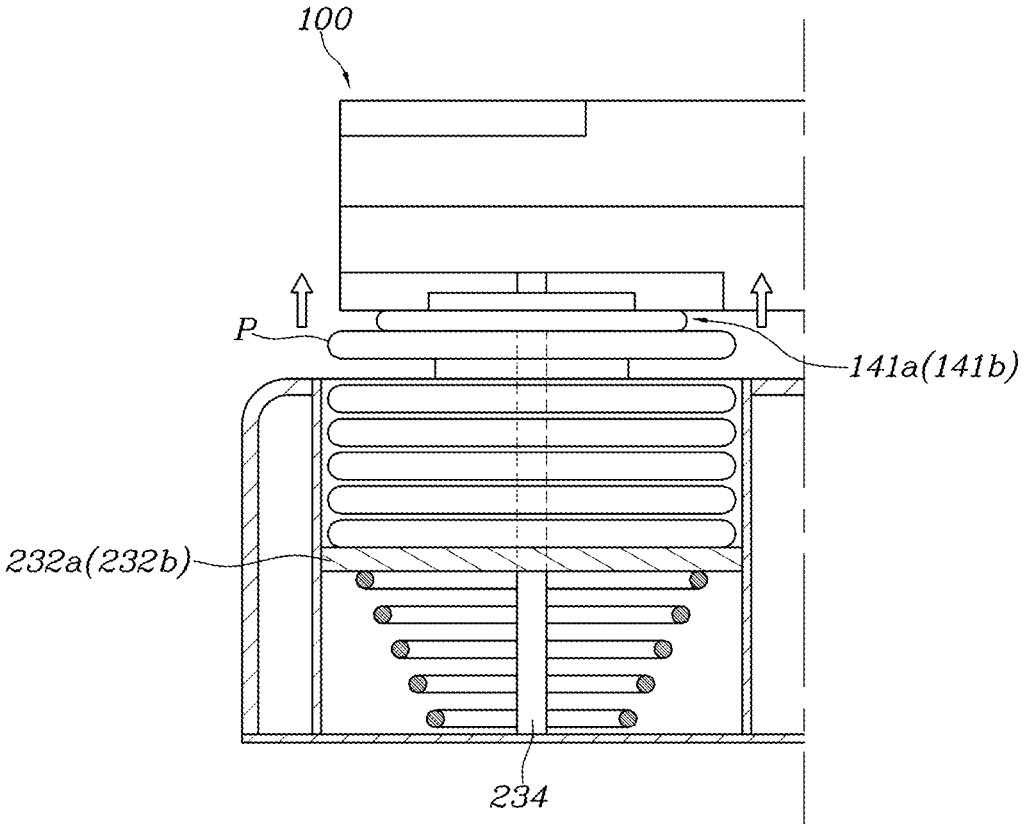

FIGS. 11A to 11C are exemplary diagrams illustrating a change in situation in a case where the damp floorcloth is attached to the robot cleaner from within the floorcloth attaching unit of the docking station, as viewed from the side, respectively, according to an embodiment. For convenience of description, an internal configuration of the floorcloth attaching unit is shown in a cross-sectional view.

As shown in FIG. 11A, in an embodiment, the robot cleaner 100 is currently in a state that it has reached the top position over the floorcloth attaching unit 230, with no damp floorcloth (P) attached thereto. According to an embodiment, the robot cleaner 100 may detect that it has reached a designated position right above the floorcloth attaching unit 230. When the robot cleaner 100 detects that it has reached the designated position above the floorcloth attaching unit 230, the robot cleaner 100 may control the driving unit to move the rotating plates 141*a* and 141*b* downward by a predetermined distance, as shown in FIG. 11B. According to an embodiment, as shown in FIG. 11B, when the robot cleaner 100 controls the driving unit to move the rotating plates 141*a* and 141*b* downward, the rotating plates 141*a* and 141*b* of the robot cleaner 100 may come into contact with the uppermost damp floorcloth among the unused damp floorcloths (P) stacked on the floorcloth trays 232*a* and 232*b* of the attachment part 230. In an embodiment, the downward movement of the rotating plates 141*a* and 141*b* may be performed within a range in which the rotating plates 141*a* and 141*b* apply a certain range of force to the floorcloth located below. Those unused damp floorcloths (P) in contact with the rotating plates (141*a*, 141*b*) may be attached to the rotating plates 141*a* and 141*b* by the attachment member provided on the lower surface of the rotating plates 141*a* and 141*b*. Then, as shown in FIG. 11C, when the robot cleaner 100 controls the rotating plates 141*a* and 141*b* to be raised through driving of the driving unit, the unused damp floorcloth (P) attached to the rotating plate 141 is caused to move out of a guide axis of the floorcloth attaching unit 230, so that the replacement of the floorcloth of the robot cleaner 100 can be completed. Thereafter, the robot cleaner 100 may move backward in a direction opposite to the entry direction to leave the docking station 200, and resume the cleaning operation according to the user's command.

The terms used in the present disclosure are used only to describe specific embodiments and are not intended to limit the disclosure thereto. For example, a component expressed in a singular form should be understood as a concept including multiple components unless the context explicitly dictates only such a singular form. As used herein, each of the phrases such as "A or B", "at least one of A and B", "at least one of A or B", "A, B or C", "at least one of A, B and C", and "at least one of A, B, or C" may include any one of the items enumerated together in a corresponding one of the phrases, or all possible combinations thereof. Further, it should be appreciated that the term 'and/or' used herein encompasses any and all possible combinations of one or more of the listed items. The terms such as "comprise(s)", "include(s)" "have/has", and "consist(s) of" used in the disclosure are only intended to designate that there are features, components, parts, or a combination thereof described in the disclosure, and are not intended to exclude a possibility of the presence or addition of one or more other features, components, parts, or a combination thereof, by using these terms. The terms such as "the first", "the second", or "first", or "second" may be used simply to distinguish a corresponding component from another corresponding component, and do not limit the corresponding components in view of other aspect (e.g., importance or order).

As used in the present disclosure, the expression 'configured to~' may be used interchangeably with, depending on the context, for example, 'suitable for~', 'having the ability to~', 'designed to~', 'modified to~', 'made to~', 'capable of~' or the like. The term 'configured to~' may not necessarily mean only 'specially designed to~' in hardware. Instead, in some situations, the expression 'a device configured to~' may mean that the device is 'capable of~' together with another device or component. For example, a phrase 'a device configured to perform A, B, and C' may imply a dedicated device for performing a corresponding operation or imply a general-purpose device capable of performing various operations including the corresponding operation.

Meanwhile, the terms 'upper', 'lower', and 'forward/backward direction' used in the disclosure are defined on the basis of the drawings, and the shapes and positions of each component are not limited by these terms.

Although the foregoing description in the disclosure has been made on the basis of specific embodiments, the disclosure is not limited to such specific embodiments, and it should be understood that it encompasses any and all various modifications, equivalents, and/or substitutes of various embodiments.

What is claimed is:

1. A docking station for a cleaner, comprising:

a docking unit including an upper surface forming a travel route along a first direction for a robot cleaner to move upon to enter the docking station; and a floorcloth separator including a protrusion, and configured so that:

the protrusion protrudes from a predetermined area of the upper surface of the docking unit such that a free end of the protrusion is defined along a second direction different from the first direction, and while a robot cleaner with a floorcloth attached thereto travels on the travel route along the first direction, at least a portion of the protrusion is inserted between the robot cleaner and the attached floorcloth to separate the attached floorcloth from the robot cleaner.

2. The docking station according to claim 1, wherein the upper surface of the docking unit includes a ramp inclined along the first direction, and the predetermined area from which the protrusion protrudes is disposed on the ramp.

3. The docking station according to claim 1, wherein the protrusion has a wedge shape protruding from the predetermined area of the upper surface at an acute angle with respect to the upper surface of the docking unit.

4. The docking station according to claim 1, wherein the docking unit includes an opening formed so that at least part of the opening is located below the protrusion, and the floorcloth separated from the robot cleaner is entered into the docking unit through the opening as the robot cleaner moves over the protrusion.

5. The docking station according to claim 1, wherein the floorcloth separator includes:

a first protrusion protruding from a first predetermined area of the upper surface of the docking unit such that a free end of the first protrusion is defined along the second direction, and a second protrusion protruding from a second predetermined area of the upper surface of the docking unit such that a free end of the second protrusion is defined along the second direction, and the first protrusion and the second protrusion are disposed to be spaced apart with a predetermined gap therebetween.

6. The docking station according to claim 5, wherein the docking unit includes a recessed area formed between the first protrusion and the second protrusion, and configured to be depressed based on a distance between the first protrusion and the second protrusion.

7. The docking station according to claim 1, further comprising:

a floorcloth attaching unit including:

a storage space formed so as to extend downward from the upper surface of the docking unit, within which a plurality of floorcloths are stackable, and an elastic support disposed on a lower part within the storage space and configured to push a plurality of floorcloths stacked within upwards.

8. The docking station according to claim 7, wherein the floorcloth attaching unit includes:

a fixing member arranged to limit, at the upper surface of the docking unit, an uppermost height of the plurality of floorcloths in the storage space being pushed upward by the elastic support.

9. The docking station according to claim 4, further comprising:

a floorcloth recovery unit disposed inside the docking unit to accommodate the separated floorcloth entered into the docking unit through the opening.

10. The docking station according to claim 9, wherein the floorcloth recovery unit has a drawer shape configured to be drawn out from one side of the docking unit orthogonal to the upper surface of the docking unit.

11. The docking station according to claim 9, wherein the floorcloth recovery unit includes a cover configured with one end connected to the upper surface of the docking unit so as to be rotatable, and to open and close at least part of the upper surface of the docking unit by rotation of the cover.

12. A cleaning system including a robot cleaner having a floorcloth unit to which a floorcloth is attachable, and a docking station corresponding to the robot cleaner, the docking station comprising:

a docking unit including an upper surface forming a travel route along a first direction for the robot cleaner to move upon to enter the docking station; and a floorcloth separator including a protrusion, and configured so that:

the protrusion protrudes from a predetermined area of the upper surface of the docking unit such that a free end of the protrusion is defined along a second direction different from the first direction, and while the robot cleaner with a floorcloth attached to the floorcloth unit travels on the travel route along the first direction, at least a portion of the protrusion is inserted between the floorcloth unit and the floorcloth to separate the floorcloth from the floorcloth unit.

13. The cleaning system according to claim 12, wherein the protrusion has a wedge shape protruding from the predetermined area of the upper surface at an acute angle with respect to the upper surface of the docking unit.

14. The cleaning system according to claim 12, wherein the robot cleaner is configured to rotatably drive the floorcloth unit, while the floorcloth is being separated from the floorcloth unit by the protrusion.

15. The cleaning system according to claim 12, wherein the docking station includes:

a floorcloth attaching unit including:

a storage space formed so as to extend downward from the upper surface of the docking unit, within which a plurality of floorcloths are stackable, and an elastic support disposed on a lower part within the storage space and configured to push a plurality of floorcloths stacked within upwards.

16. The cleaning system according to claim 15, wherein the floorcloth unit is configured to move up and down within a predetermined distance along a height direction of the robot cleaner, and when the floorcloth unit is positioned above the floorcloth attaching unit with a floorcloth not being attached to the floorcloth unit, the robot cleaner is configured to move the floorcloth unit downward so that the floorcloth unit comes into contact with an uppermost floorcloth among the plurality of floorcloths stacked in the floorcloth attaching unit.

17. The cleaning system according to claim 12, wherein the docking unit includes an opening formed so that at least part of the opening is located below the protrusion, and the floorcloth separated from the robot cleaner is entered into the docking unit through the opening as the robot cleaner moves over the protrusion.

18. The cleaning system according to claim 17, further comprising:

a floorcloth recovery unit disposed within the docking unit to accommodate the separated floorcloth entered into the docking unit through the opening.

19. A robot cleaner comprising:

a floorcloth unit to which a floorcloth is detachably attachable; and a driving unit configured to rotate the floorcloth unit, wherein the driving unit is configured to, while travelling on a docking unit in a state that the floorcloth is attached to the floorcloth unit, rotate the floorcloth unit when detecting that a predetermined protrusion on the docking unit for separating the floorcloth from the floorcloth unit is partially inserted between the robot cleaner and the floorcloth.

20. A docking station for a cleaner, comprising:

a docking unit including an upper surface forming a travel route for a robot cleaner entering the docking station; and a floorcloth attaching unit formed to be recessed from the upper surface of the docking unit, the floorcloth attaching unit including:

a storage space in which a plurality of floorcloths can be stacked, and a floorcloth support disposed at a lower part within the storage space, including:

a support member configured to support one or more floorcloths, and an elastic member configured to bias the support member so as to push a plurality of floorcloths stacked within the storage space upwards.

* * * * *